United States Patent [19]

Scott

[11] Patent Number: 4,550,550

[45] Date of Patent: Nov. 5, 1985

[54] AUTOMATED MINERAL WOOL ROLL-UNIT PROCESSING SYSTEM

[75] Inventor: Peter T. Scott, Bogart, Ga.

[73] Assignee: CertainTeed Corporation, Valley Forge, Pa.

[21] Appl. No.: 480,941

[22] Filed: Mar. 31, 1983

[51] Int. Cl.[4] ..... B65B 1/24

[52] U.S. Cl. ..... 53/529; 53/504; 53/438; 53/118; 209/558; 209/604

[58] Field of Search ..... 53/118, 430, 438, 504, 53/529; 198/369, 371, 394, 406, 461; 209/545, 558, 600, 601, 604, 605

[56] References Cited

U.S. PATENT DOCUMENTS

| | | | |
|---|---|---|---|
| 2,026,469 | 12/1935 | Hamilton | 53/131 |
| 2,140,246 | 12/1938 | O'Neil | 198/394 |
| 2,768,489 | 10/1956 | Brown, Jr. et al. | 53/74 |
| 2,782,754 | 2/1957 | Bookidis | 198/406 |
| 2,869,297 | 1/1959 | Neer | 53/243 |
| 3,089,594 | 5/1963 | Early | 209/525 |
| 3,414,139 | 12/1968 | Strommen | 414/35 |
| 3,426,921 | 2/1969 | Parshall | 414/330 |
| 3,442,400 | 5/1969 | Roth et al. | 414/43 |
| 3,447,227 | 6/1969 | Wollman | 29/239 |
| 3,468,415 | 9/1969 | Sarver | 209/605 |
| 3,507,453 | 4/1970 | Scragg et al. | 242/18 A |
| 3,690,487 | 8/1972 | Evans, Jr. et al. | 198/394 |
| 3,818,673 | 6/1974 | Rollins | 53/438 |
| 3,964,232 | 6/1976 | Bender et al. | 53/430 |
| 4,042,140 | 8/1977 | McFarland | 414/24.5 |
| 4,230,218 | 10/1980 | Kunzmann | 198/461 |
| 4,281,756 | 8/1981 | Bruno | 198/369 |
| 4,341,003 | 7/1982 | Kopena | 414/330 |
| 4,391,560 | 7/1983 | Fardin | 198/406 |

FOREIGN PATENT DOCUMENTS

| | | | |
|---|---|---|---|
| 759876 | 3/1953 | Fed. Rep. of Germany | 198/406 |
| 2025185 | 11/1971 | Fed. Rep. of Germany | 198/461 |
| 573608 | 2/1958 | Italy | 209/604 |
| 618329 | 8/1978 | U.S.S.R. | 198/406 |

*Primary Examiner*—Francis S. Husar
*Assistant Examiner*—Jorji M. Griffin
*Attorney, Agent, or Firm*—Paul & Paul

[57] ABSTRACT

A method and system for packaging insulation units comprising a receiving section that indexes each roll-set that comes off a production line, a roll breaking section that separates the roll-set into individual units and spaces each unit, a diverter section that verifies height and facing and then diverts a selected roll unit to the proper packaging material and a packaging section that receives a roll unit, orients it properly, and packages it in the proper packaging. The system allows rejection of unsuitable product and reduced handling of product by employees.

8 Claims, 17 Drawing Figures

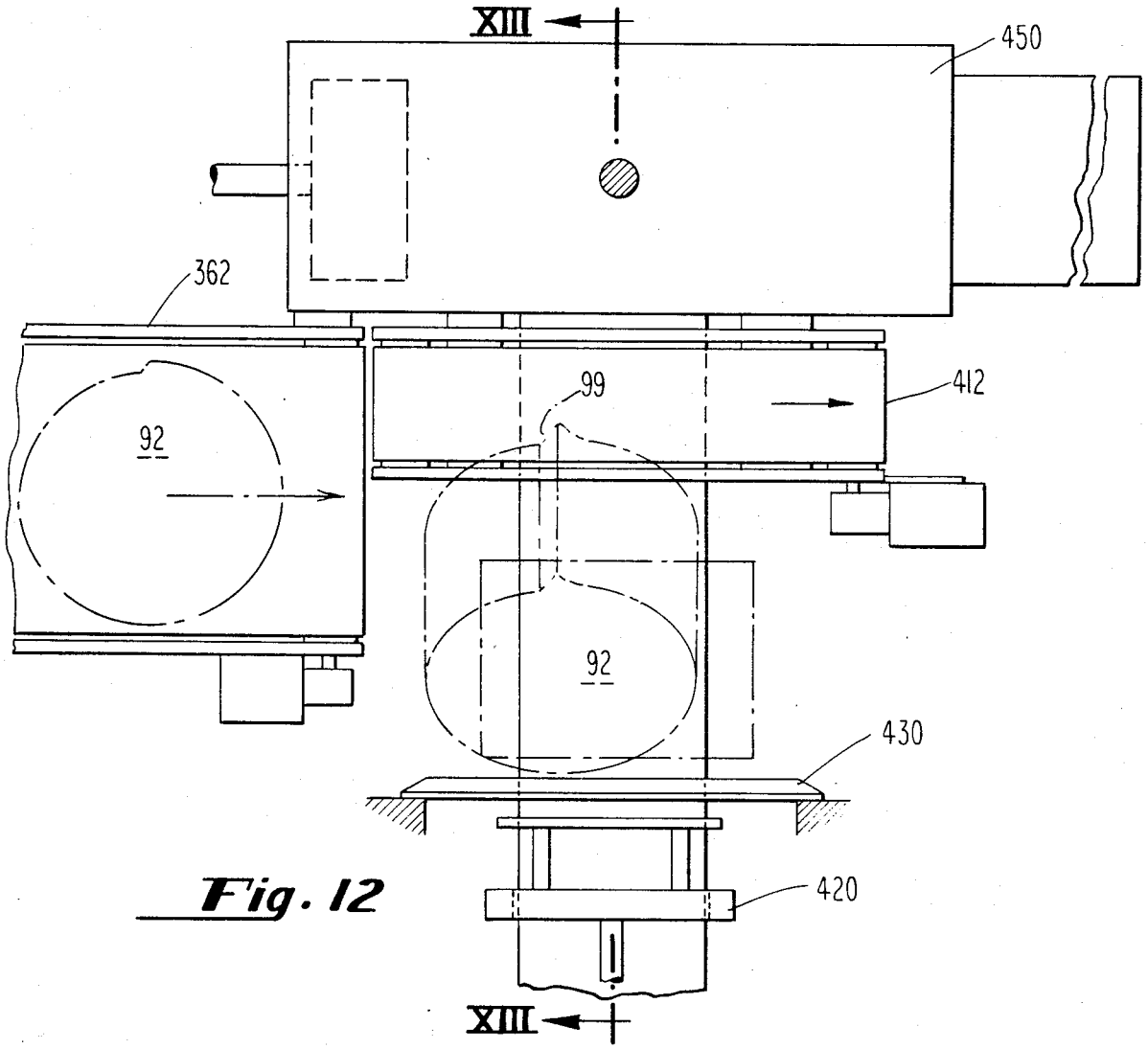
Fig. 12
Fig. 13
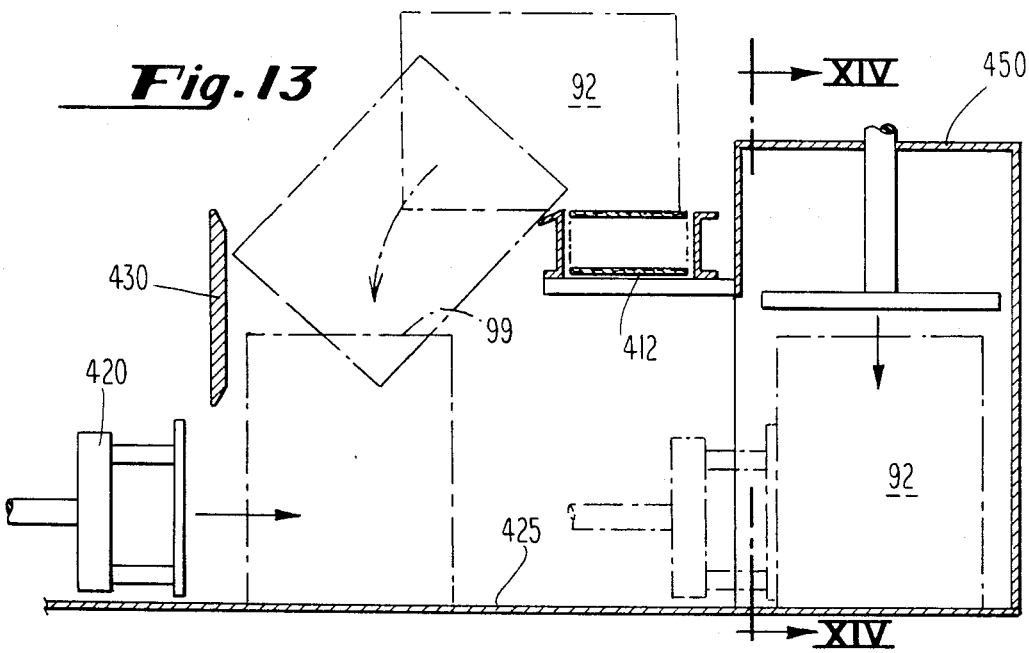

AUTOMATED MINERAL WOOL ROLL-UNIT PROCESSING SYSTEM

FIELD OF THE INVENTION

This invention relates to the insulation industry. More particularly, the invention allows faster and more efficient processing of mineral wool building insulation rolls to prepare them for packaging for the retail market.

DESCRIPTION OF THE PRIOR ART

There is an increased requirement for rolls or packages of mineral wool building insulation material as energy conservation becomes important. In different areas of the country, there is a demand for various and special types of these products. Industrial plants that produce mineral wool, e.g. fiberglass insulation products, have complex operations to process and package large quantities of the various styles and sizes of insulation to meet this demand.

Handling and processing fiberglass is not an easy task. The very nature of fiberglass, with the individual fibers becoming entwined with one another, makes fiberglass cumbersome to handle. Large mats of fiberglass that have been cut into strips will stick to one another when rolled up side-by-side almost as if never having been cut because of this nature.

Combined with the difficult nature of the handling of fiberglass are the many processing steps that must be accomplished before a product can be sent to market. If rolls of fiberglass are to be produced, the R factor (Resistance factor), i.e. thickness and density, and the width of the mat (which is the height of the roll; for example, 11 inches, 15 inches or 23 inches) have to be determined. Also, either faced (for example, foil or brown paper) or unfaced insulation may be produced. Then, after it is determined to produce a certain quantity of each kind, and that quantity is in fact produced, all units must be wrapped or packaged in some type of protective packaging. This packaging is generally marked to describe the particular type of insulation and the matching of product to packaging must be precise.

The insulation industry has traditionally dealt with the above-described problems by using large numbers of workers. Some of these workers count the rolls as they are sent to different stations, some merely carry rolls from one station to another. The whole process from start to finish, even with a large labor force, is very time-consuming. This results in less insulation produced than is needed. The invention hereindescribed is intended to make more efficient the handling and packaging of insulation by mechanizing the process.

SUMMARY OF THE INVENTION

The present invention processes roll-sets of individual fiberglass insulation roll units. The system allows the efficient and quick processing of large numbers of roll units and classifies and verifies individual units to allow packaging of these units in the proper casing or packaging material. As a result of the present invention, there is an indexing section which accepts a roll-set from the end of a production line. The indexing section orients the roll-set to set the end tab, or edge of the insulation strip, for each individual roll unit in a preselected position to prevent it from sticking out of the bag in the final operation. In addition, if the system operator notices a defect in a particular roll-set, the indexing section can be activated to reject that roll-set and allow for either discard or correction before it is further processed.

The roll-set is then sent to a roll-break section where it is separated into individual roll units along precut slits. As these individual units proceed through this section they are caused to be sufficiently spaced apart so that there will be a desired sufficient predetermined time between each step of further processing. The roll-break section also turns each roll unit from its side onto its end for it to enter the next section of the processing system.

The roll units are then conveyed through a steering section which accomplishes a verification process. The verification process insures that roll units of the proper height are directed toward the correctly marked wrapping material. The steering section also insures that the proper number of roll units is being processed through the line and keeps an accurate count of all units of various sizes and facings. The steering section steers the roll unit through a 90° turn towards the packaging section that has the proper packaging material for that unit.

The final steps that the packaging system accomplishes are to tilt an individual roll unit back onto its side so that it is oriented properly when it is pushed into a bagging machine, and then to bag each unit. To do this, a thin conveyor at the end of the delivery conveyor carries a fractional portion of the bottom surface of the unit out over the delivery table until the unit tips over and comes to rest on its side on the table below. This tilting step "hides" the end tab of the unit by placing it in about a 10 to 12 o'clock position or a 4 to 6 o'clock position when it is pushed into a packaging material, for example, into a bag. In these approximate positions the end tab will not protrude from the bag in the finished package.

OBJECTS OF THE INVENTION

It is therefore an object of the invention to provide an apparatus for handling multitudes of individual fiberglass roll units automatically, quickly and efficiently.

It is another object of the invention to provide an apparatus for handling multitudes of individual fiberglass roll units that will allow counting, indexing, and error-detecting of a roll-set before it is further processed.

It is a still further object of the invention to provide a mechanized fiberglass roll unit handling system that permits detecting defects in roll-sets that are sent into the system, and that enables rejection of defective units without compromising system efficiency and speed.

It is a further object of the invention to provide an apparatus for separating adjacent fiberglass roll units of a common roll-set wherein there is some fiber interentanglement of fiberglass between adjacent roll units in the set, one from the other.

It is a still further object of the invention to provide an apparatus that will automatically count, control and manage fiberglass roll units of various sizes and facings so that all units end up in the correct packaging.

Other objects and advantages of the present invention will be readily apparent to those skilled in the art by reading the following brief descriptions of the drawings, detailed description of the preferred embodiment and the appended claims.

BRIEF DESCRIPTION OF THE FIGURES

FIG. 12 Fragmentary plan view of Placement Section 400, showing tilt of a roll (in phantom) off narrow conveyor.

FIG. 13 Fragmentary cross-sectional view taken along XIII—XIII of FIG. 12, showing the roll tilt of FIG. 12.

DESCRIPTION OF THE PREFERRED EMBODIMENT

Figure 1:
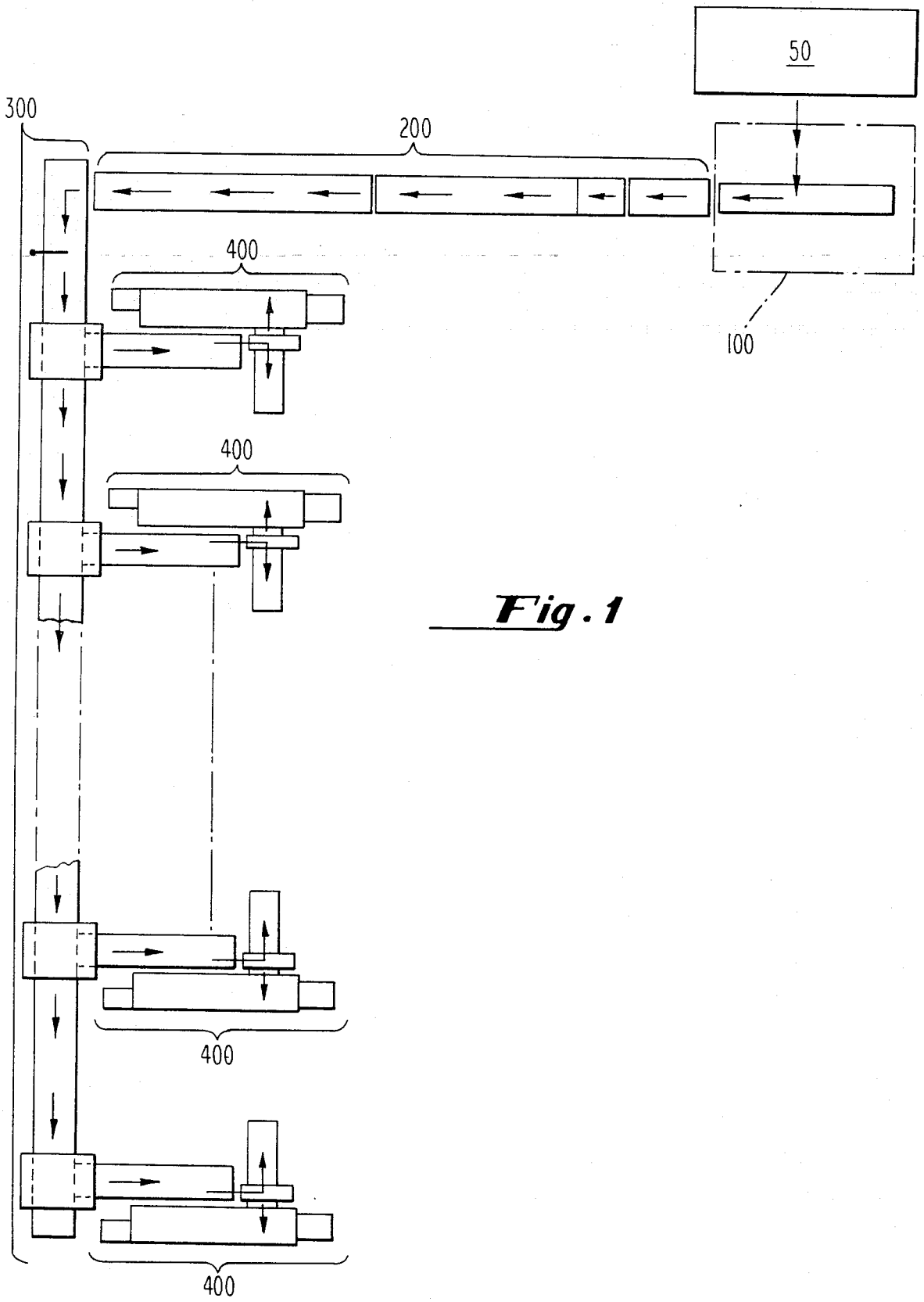
FIG. 1 Schematic plan view of the Automated Insulation Roll Processing system.

Turning now to FIG. 1, a schematic view of the present invention of an automated fiberglass insulation roll processing system is shown for travel of roll units thereon, in the directions of the various arrows as shown. A roll-set, comprised of a number of individual roll units (for example, six) that stick to one another by the entanglement of fiberglass fibers, is issued in a taped condition from a rolling-up machine 50, into an indexing section 100. Indexing section 100 receives a roll set in a cradling mechanism and rotates it until an end tab is in a predetermined position. Further processing of the roll-set throughout the processing system is based on the end tab being in this pre-determined position (of FIG. 6D) to facilitate handling of the individual roll units and to improve the appearance of the final package that will be shipped to the customer. Indexing section 100 also allows the automatic rejection of any particular roll-set that has a defect in it. This defect may take the form of an untaped end of any particular roll unit in the set or a problem such as uneven appearance in the insulation roll unit caused further back in the production line, or any other defect. Finally, indexing section 100 conveys the roll-set to the next section 200.

A roll-set breaking section 200 receives the roll-set from indexing section 100. Due to the nature of fiberglass fibers, the individual sections that were precut further back in the production line (not shown) have fibers of adjacent roll units in the same roll-set that are in an intertwined or inter-entangled relation so that these adjacent rolls are almost as though permanently joined. Roll break section 200 accomplishes the separation of these roll units. Roll-set break section 200 puts sufficient spacing between individual roll units after they are separated and then tips each roll onto its end for further processing.

Adjacent to section 200, but constructed to operate at a transverse direction thereto, is steering section 300. Section 300 has a main transport conveyor to receive an individual roll unit on its face at a predetermined lower elevation and transport it through a verification process. The verification process detects a roll unit as it passes, and verifies the height and the type of facing, either foil or non-foil (unfaced or Kraft), that that roll unit has. When the proper height and facing combination is detected, steering section 300 sends that particular roll unit towards the proper one of a plurality of bagging machines. This is done by forcibly pushing the roll unit in a transverse direction to one of a plurality of lateral lead-in conveyors disposed at right angles to, but coplanar with, the main transport conveyor by the use of guide arms. Steering section 300 can detect when a roll unit arrives that is an improper unit for any of the bagging machines and cause that roll unit to be removed from further processing.

A plurality of placement sections 400 are located at the ends of the lateral lead-in conveyors and adjacent steering section 300. Each is of identical construction or of mirror-image construction to the others. Each placement section 400 sets a single roll unit onto its associated bagging machine entry surface with the proper orientation of the end tab so that when that roll unit is shoved inside the bagging machine, and compressed by the pressure plate inside the bagging machine, the end tab edge does not drag, rumple or catch as the compressed roll unit is being shoved into the packaging material.

In the numbering of the elements herein, the letters L and R shall refer to the left-side and right-side, respectively, and the letters F and A shall refer to the forward end and the aft end, respectively. The letters U and $L_r$ refer to upper and lower locations, respectively.

As roll-set 90 is issued out of the set rolling machine 50, it proceeds into the indexing section 100. In a preferred arrangement, the machinery of section 100 is located below the surface of the plant floor which is designated by line A in the drawings. However, in other applications, this machinery 100 could easily be in an elevated position and work comfortably with the remainder of the system.

As roll-set 90 proceeds out of rolling machine 50, it passes over a sensing device such as electric eye 109 (FIG. 3), of a type known in the electrical art. Eye 109 detects the passage of roll-set 90 into the cradling mechanism 110 and sends an appropriate signal to activate the rotation of rollers 127 as is later described. Mechanism 110 is above a conveyor 160.

Figure 2:
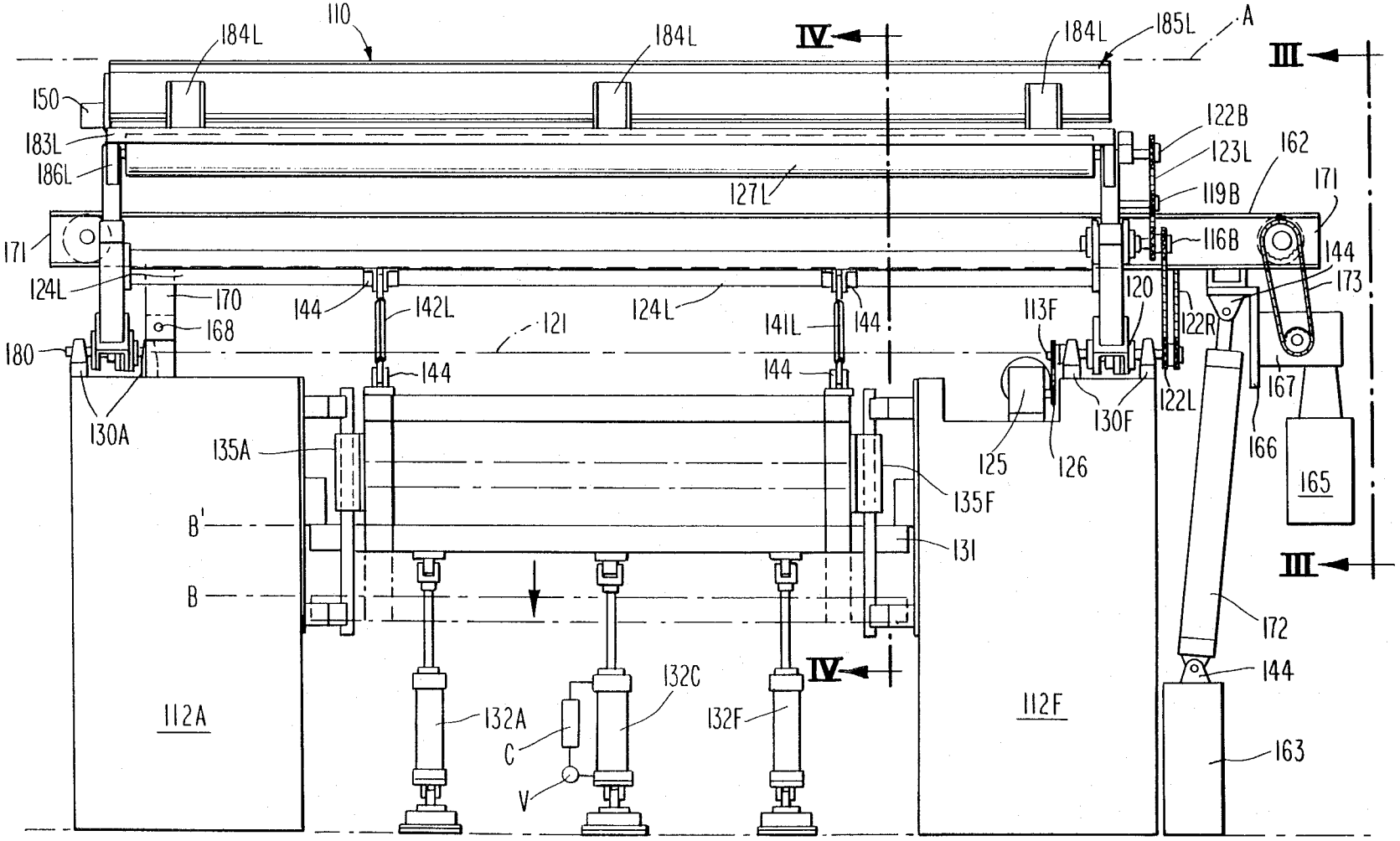
FIG. 2 Longitudinal elevation of indexing section 100 of FIG. 1.
Figure 3:
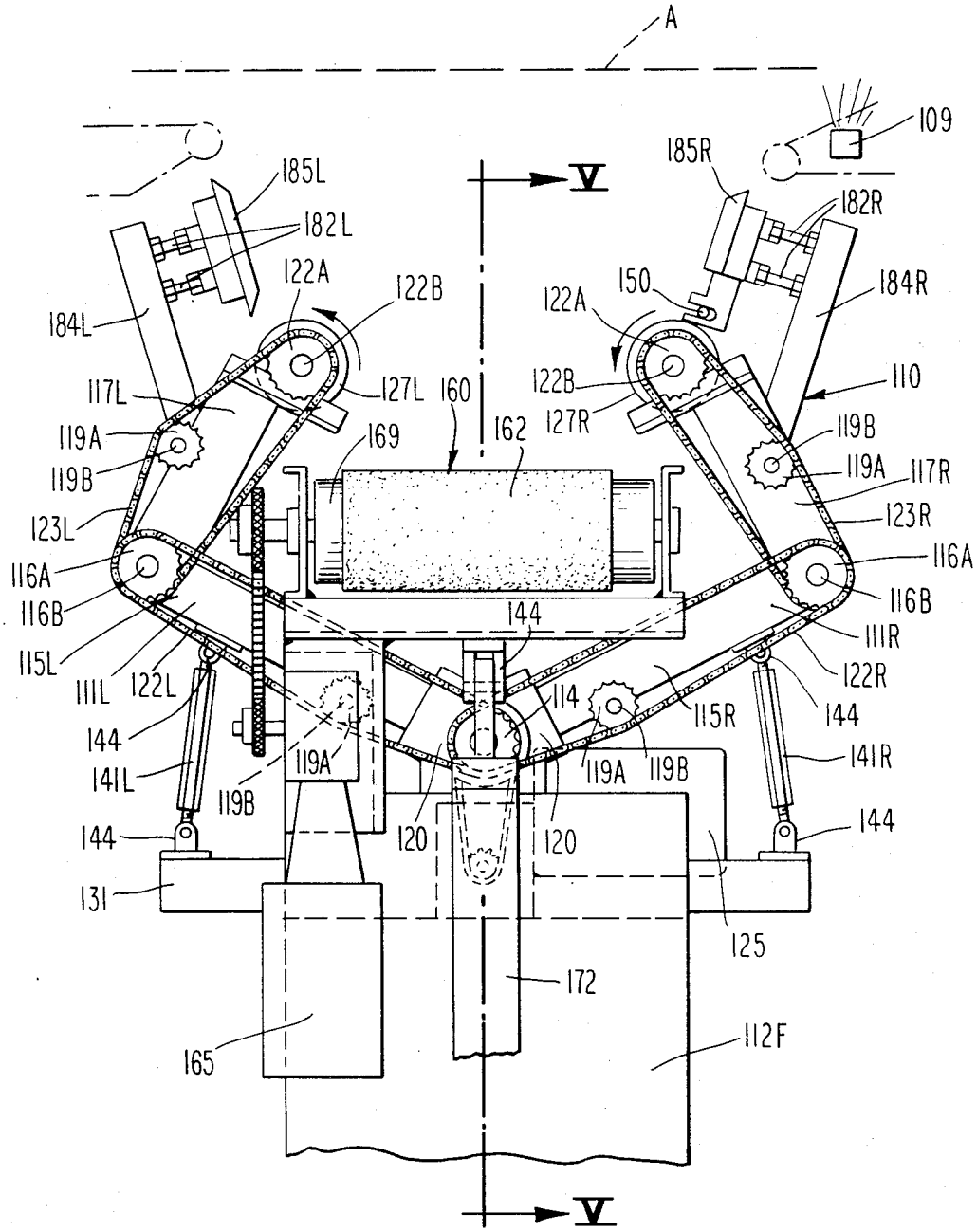
FIG. 3 Enlarged fragmentary end view along III—III of FIG. 2.
Figure 4:
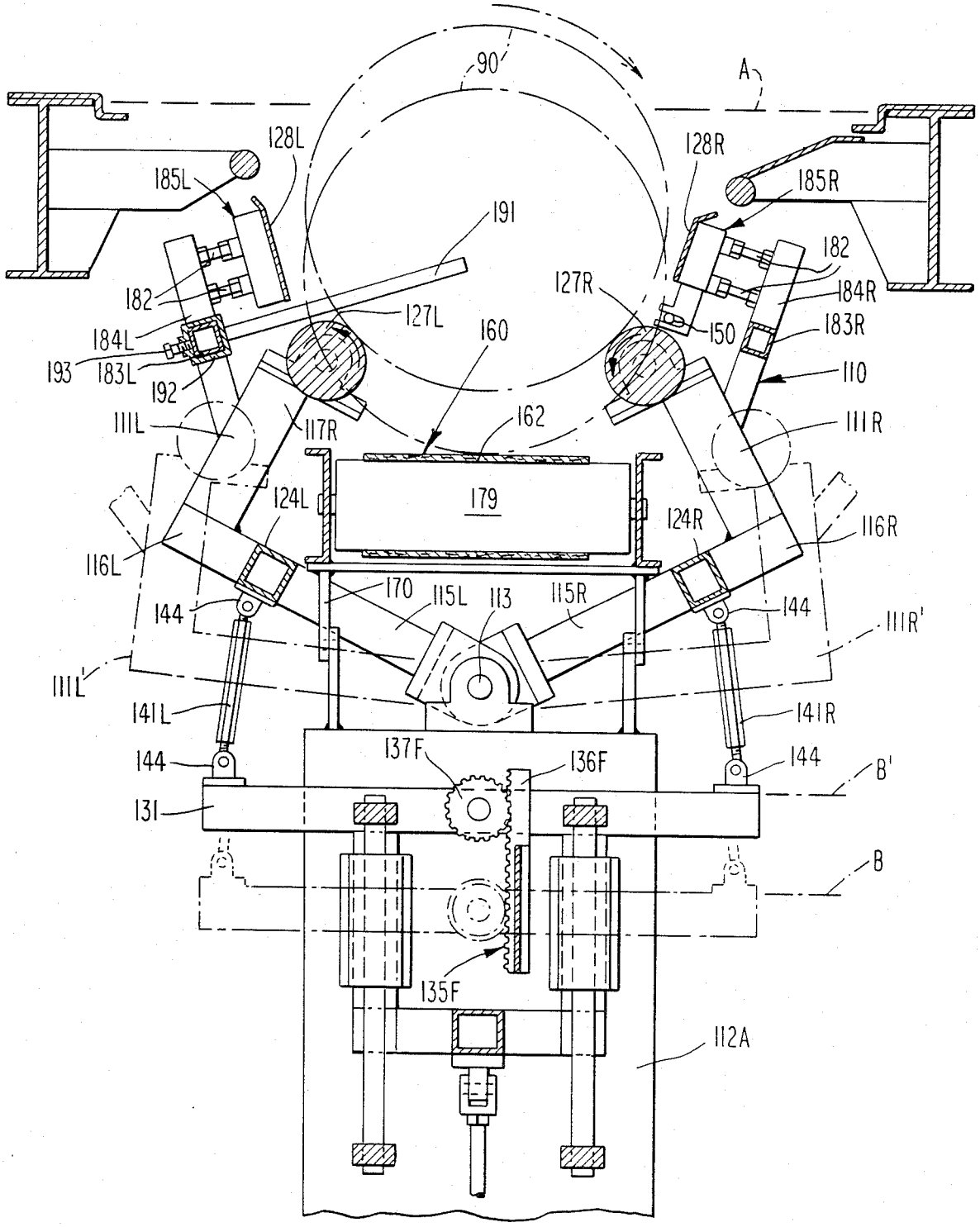
FIG. 4 Enlarged fragmentary cross-sectional view along IV—IV of FIG. 2 showing separation action of scissor-arms, between full line and phantom positions, whereby roll-set (shown in phantom) is set down onto conveyor.

One of the novel features of the system is the pair of spaced-apart scissor arms 111L and 111R that comprise the main working components of mechanism 110. Scissor arms 111 are located in a spaced apart relationship of a predetermined distance along the same elevation and are pivotable about a common axis 121 (FIG. 2). As shown in FIGS. 3 and 4, each set of arms 111 is comprised of a lower arm 115 and an upper arm 117 joined at a 90° angle at elbow 116. The front (or right as viewed in FIG. 2) L-shaped arms 111L and 111R pivot on bearings 120 around a central drive shaft 113F, and, have drive chain sprockets 122A, 116A, and tensioner sprockets 119A rotatable about pins and lock washers 122B, 116B, 119B respectively, located at the right-most end of FIG. 2. The pair of arms has at its upper ends as viewed in FIG. 3, a pair of longitudinally parallel rollers 127L and 127R which cradle therebetween and make driving contact with roll-set 90, and which are driven by sprocket mounted chains 122 and 123 that, in turn, are connected to and driven from central drive sprocket 114. Sprocket 114 is on and driven by drive shaft 113F, on common axis 121. Shaft 113F is driven through a suitable sprocket and chain arrangement 126 by a first drive means 125 located immediately adjacent thereto (FIG. 2), preferably an AC fixed speed motor as is known in the art. The pairs of longitudinally spaced apart arms at each end of axis 121 are rigidly and fixedly joined by horizontal brace bars 124L and 124R, respectively, to further coordinate uniform and simultaneous movement between them. The arms 111L and 111R operate through brace bars 124L and 124R (FIGS. 2 and 3) to drive substantially identically constructed counterparts of arms 111L and 111R at the aft end of mechanism 110 (the left side as viewed in FIG. 2) that are mounted on a pin 180 for rotation thereon.

Attached at the upper outer edge of each arm 117, on opposite sides thereof, are bumper pans 185L and 185R. Bumper pans 185 run the length of the cradling mechanism 110 and are fixed to and carried by pan spacer supports 182, that in turn are mounted on and carried by upstanding struts 184L and 184R. The pans 185L and 185R act as fenders to guide roll-set 90 into cradling mechanism 110. Struts 184 are, in turn carried by longitudinally disposed bars 183L and 183R, that, in turn are fixedly carried by arm-mounted connecting struts 186. Support pans and struts are constructed of ordinary materials known in the art to be lightweight, yet sturdy. Alternatively, bumper pan 185L can be omitted. With particular reference to FIG. 4, a pair of guide forks 191 may be provided, fore and aft, carried for movement with strut 184L upon pivoting of scissors arm 111L, so that in the full line position of scissors arm 111L as viewed in FIG. 4, the forks 191 extend partially across the ends of a roll-set carried on rollers 127L and 127R, to guidingly maintain the approximate position of the roll-set in indexing section 100, to keep the roll-set, or a portion thereof, (in the event that a given roll or rolls of the roll-set breaks free of the remainder of the roll-set) from "walking" in the direction of the axis of rollers 127L and 127R as the rollers are rotated. The forks 191 are each carried on slider means 192 that are carried for slidable positioning along bar 183L, and are secured in any desired position by means of fastening means 193, which can be a threaded fastener or the like.

Figure 6A:
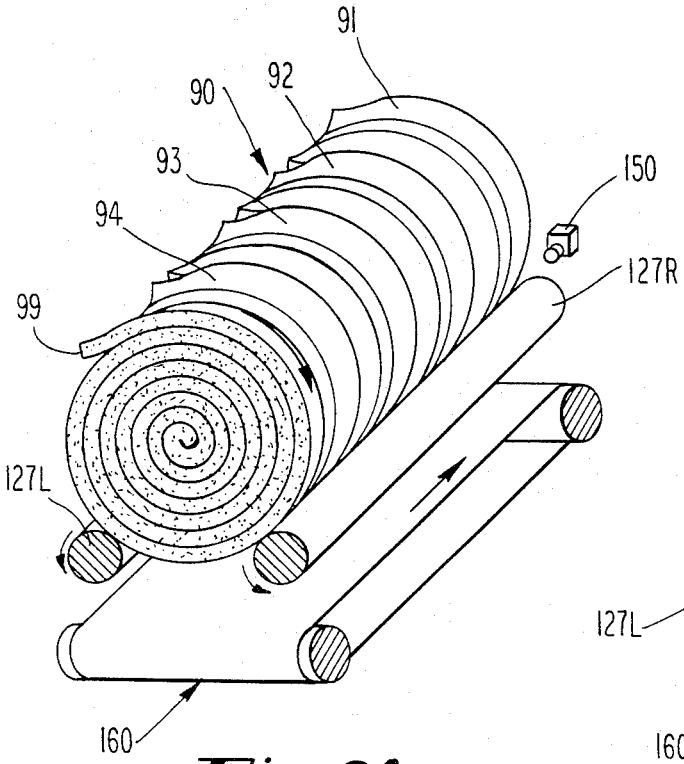
FIG. 6A,B,C,D Sequence of simplified schematics showing indexing of roll-set to desired predetermined orientation.

As roll-set 90 rotates against pans 185L and 185R (as seen in FIG. 4), an end tab 99 scrapes against inner surface 128L and 128R of the pans. End tab 99 makes a full revolution around and breaks longitudinally directed beams (see FIGS. 6A, B, C and D) from one or more photoeyes 150, registering a count. As will be explained later, once photoeye 150 is thus activated by end tab 99, a timing mechanism controls the amount of further rotation of and stopping of rollers 127.

Indexing section 100 has two base structures 112A, 112F that provide a predetermined amount of elevation for cradling mechanism 110. Structures 112A, 112F are located beneath a first level A inside indexing section 100. Drive shaft 113F and pin 180 are each carried by suitable bearing or other support members 130A, 130F to allow pivotable action thereabout by arms 111L and 111R and their opposite end counterparts. Arms 111L and 111R can thus move between the full line and phantom positions, 111L' and 111R' shown in FIG. 4. Support members 130A, 130F are fixably attached to the top of each base 112A, 112F, respectively.

The opening and closing of cradling mechanism 110 is controlled by a lifting table 131 conveniently located in a moving relationship in between bases 112F and 112A. Table 131 is a rectangular shaped structure made of strong but lightweight material as is known. The bottom surface of table 131 is fixedly carried by the tops of pneumatic cylinders 132F, 132A. Cylinders 132F and 132A are set against the indexing pit floor and are controlled to produce an up-stroke and a down-stroke (controls not shown) as is known in the art. Similarly, cylinder 132C is provided, as a closed loop, with a control C and valve V which may be set to permit arresting the scissors arm movement at various intermediate positions according to the diameter of a given roll-set.

Lifting table 131 has at opposite longitudinal ends dampening rack and pinion sets 135F and 135A. Sets 135F and 135A are composed of racks 136F and 136A, that are firmly fixed to bases 112F and 112A, respectively, and pinion gears 137F and 137A in meshing engagement with the respective rack. Gears 137F and 137A are fixed for rotating movement to the front and rear ends of table 131. Sets 135F and 135A act to dampen any nonuniform movement between the front and the rear ends of table 131, thereby coordinating such movement.

On opposite left and right sides of the top of table 131 are a pair of turnbuckle rods 141L, 142L and 141R, 142R. All rods are joined for angular movement between table 131 and horizontal bracing bars 124L and 124R by clevis brackets 144. This connection transmits the up or down movement of cylinders 132F and 132A through table 131 to bars 124L, 124R to scissor arms 111L and 111R. With table 131 in the raised position B' (in FIG. 2), arms 111L and 111R are in a closed relation. With table 131 in the lower position (in phantom) B, arms 111L and 111R are open and roll-set 90 drops onto conveyor 160.

As the table 131 raises up, as forced by the power stroke of the pneumatic cylinders 132F and 132A, L-shaped scissor arms 111L and 111R pivot about central pin 113. This motion causes roller 127 on each tip of scissor arm 111 to swing through an arc of approximately 20° (as shown in phantom in FIG. 4) so that the combined effect of scissor arms 111 (and their counterparts at the aft end) is to converge above conveyor 160. Indexing section 100 in this position is ready to receive roll-set 90 from the roll-forming machine. Until such time as the roll-set has been properly indexed according to photo-sensor 150, pneumatic cylinders 132F, 132A, are powered up which in turn maintains lifting table 131 in this raised position.

Indexing conveyor 160 transports roll-set 90. Conveyor 160 has a broad conveyor belt 162, disposed to make a continuous loop around driven belt pulleys or cylinders 169 and 179, that, in turn are rotationally mounted at ends of a longitudinally disposed frame 171, with cylinder 169 having its shaft driven through a conventional sprocket and chain arrangement 173, that, in turn is driven by motor 165 through gear reduction device 167. The motor 165 is an AC reversible and, preferably, fixed motor, as is known in the art. The gear reduction device 167 is mounted to support plate 166 and has motor 165 carried thereby. Motor 165 is electronically connected to a control circuitry (not shown) to receive and send signals and to start and stop motor 165 in either the forward or reverse modes. In this respect motors 125 and 165 are similarly controlled from the control circuitry.

Figure 5:
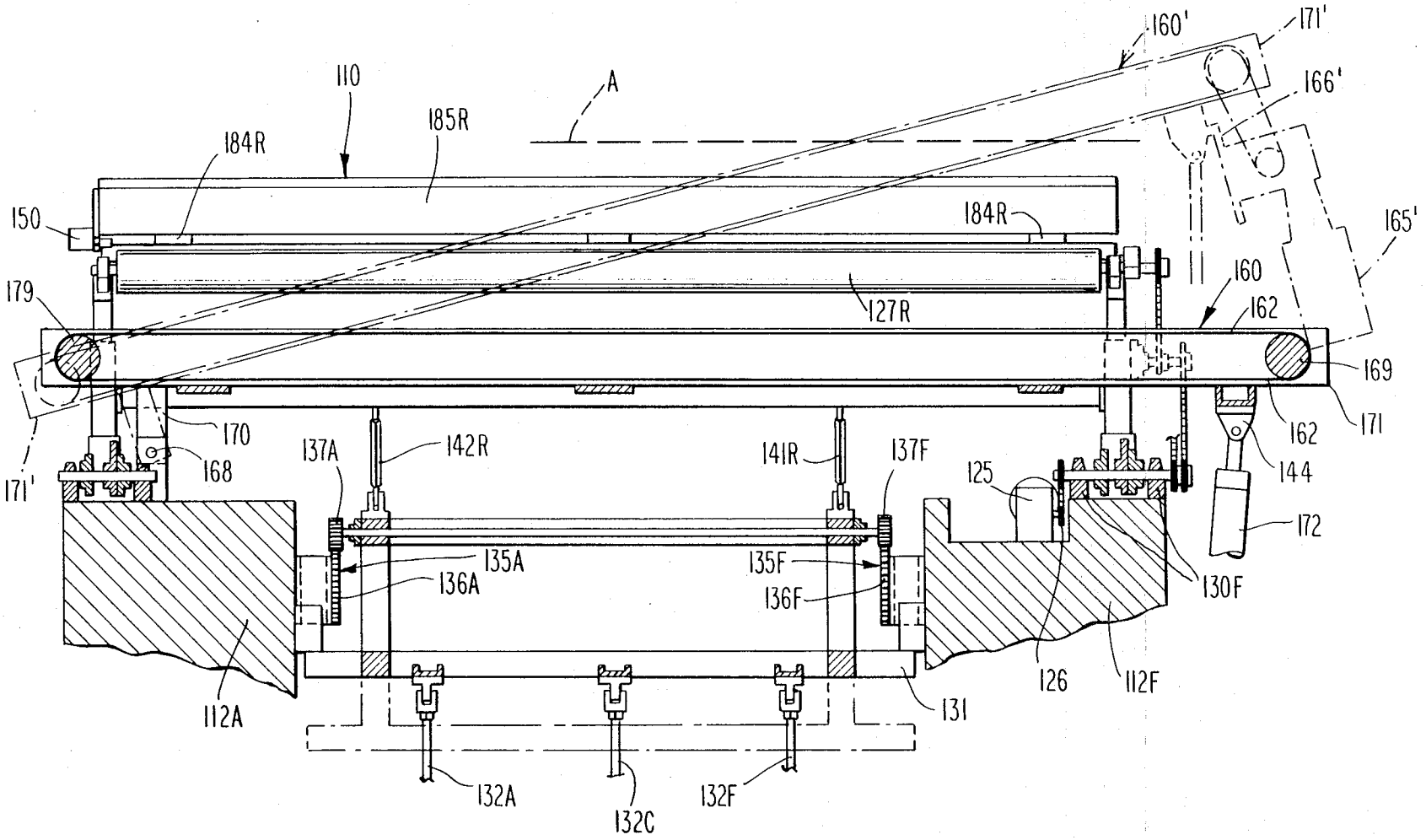
FIG. 5 Fragmentary longitudinal sectional view along V—V of FIG. 3.

Another of the novel features of the present invention is the capability to reject a defective roll-set 90. Conveyor 160 is pivotable at its aft end about pin 168. Pin 168 is housed in pivot housing 170 atop base 112A. At the front end of conveyor 160, a pneumatic cylinder 172, of the type previously described, extends from a housing 163 to support plate 166 on frame 171. Clevis brackets 144 provide pivoting attachment of cylinder 172 to support 163 and plate 166. Cylinder 172 is connected to an appropriate source and control (not shown) so as to raise conveyor 160 above ground level A (FIG. 5) as shown in phantom elevation at 160'. Motor 165 which normally drives the upper run of the conveyor belt 162, leftward as viewed in FIG. 5, when reverse driven, will drive the upper run 162 rightward as viewed in FIG. 5, whereby roll-set 90 is ejected from indexing section 100. Then motor 165 returns to a forward motion, cylinder 172 lowers conveyor 160 and table 131 raises arms 111L and 111R to pivot to the closed position to receive another roll-set.

Figure 7:
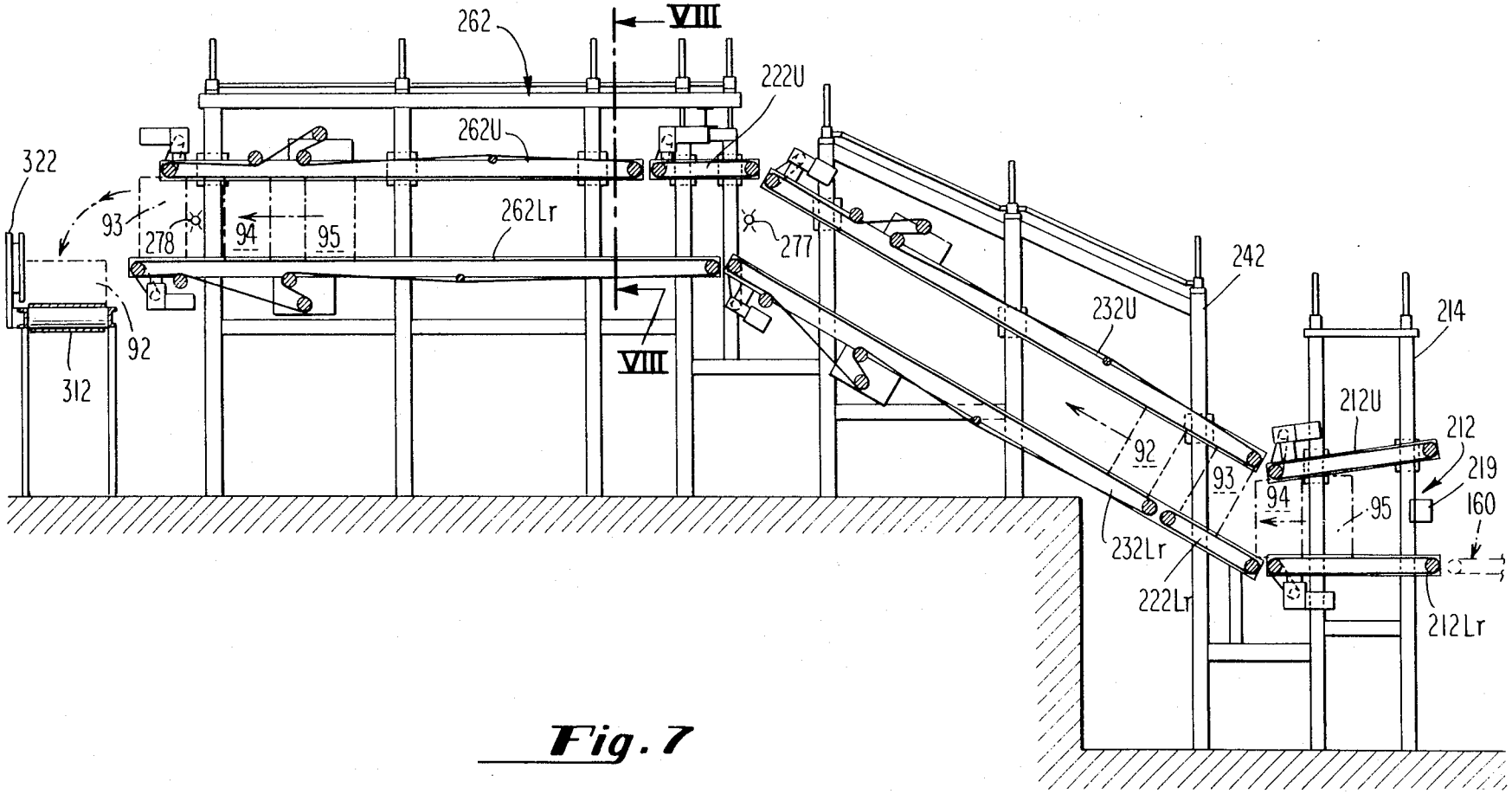
FIG. 7 Longitudinal sectional view of roll breaking section 200.

After roll-set 90 has been properly indexed so that end tab 99 is in a preselected position, e.g. the 3 o'clock position, it is conveyed out of indexing section 100 and into roll break section 200 by indexing conveyor 160. As roll-set 90 leaves indexing conveyor 160, it is immediately accepted by a tractor conveyor 212 (as shown in FIG. 7) and is guided to be centered as it enters section 200, by a pair of converging guide plates 219 carried by framework structure 214, and which are located on the left and right sides of the conveyor path as for contact by left and right sides of a roll unit entering conveyor section 200. Conveyor 212 has upper and lower tractor conveyor sections, 212U and 212L$_r$ respectively, with lower section 212L$_r$ being positioned on a framework structure 214 so that it is at the same elevation as the indexing conveyor 160. Upper tractor conveyor section 212U is positioned on framework structure 214 so that it converges from the front to the aft toward lower section 212L$_r$, as shown in FIG. 7. Upper section 212U preferably forms an angle with a horizontal of approximately 8° to 12°. These conveyors are driven by an AC variable motor (not shown) connected to appropriate drive gears (not shown) as is known in the art and such as have been described earlier in this application. Both upper section 212U and lower section 212L$_r$ operate at approximately the same speed, and this forces the top section of roll-set 90 to be squeezed as it is transported between the two sections as is shown for the portion of the roll-set shown in phantom therebetween.

As a roll unit is squeezed out of the upper 212U and lower 212L$_r$ sections, the bottom surface of a roll unit is immediately engaged by a faster moving lower roll-break conveyor 222L$_r$. As can be seen from FIG. 7, lower roll-break conveyor 222L$_r$ operates to transport the bottom surface of first roll unit 92, and thereafter succeeding roll units in roll-set 90, through an arc to separate it from the face of an adjoining roll unit, against the forces of unit-to-unit fiber entanglement. Lower roll-break conveyor 222L$_r$ is driven in the normal methods and means by still another AC variable speed motor (not shown) but generally at a faster speed than the AC motor driving sections 212U and 212L$_r$.

As the top of roll unit 94 is forced through the restricted opening formed by upper tractor conveyor section 212U, it is conveyed by an upper incline conveyor 232U. Adjacent lower rollbreak conveyor 222L$_r$ is a lower incline conveyor 232L$_r$. Lower incline conveyor 232L$_r$ and lower roll-break conveyor 222L$_r$ are all parallel to upper incline conveyor 232U, and are carried by a structure 242 similar to that carrying the upper and lower tractor conveyor sections. The incline between the horizontal and the lower conveyors is approximately 30°. Conveyor sections 232U and 232L$_r$ are preferably driven slower than section 222L$_r$, but faster than sections 212U and 212L$_r$.

It will be seen that the roll units 92 through 95 thereby become spaced apart from each other. Once individual roll units 92, 93, 94 and 95 arrive at the top of the incline, they are transported onto a holding tractor section 262. Holding tractor section 262 has a lower horizontally disposed conveyor 262L$_r$ and an upper generally parallel and horizontally disposed upper tractor conveyor 262U.

Figure 8:
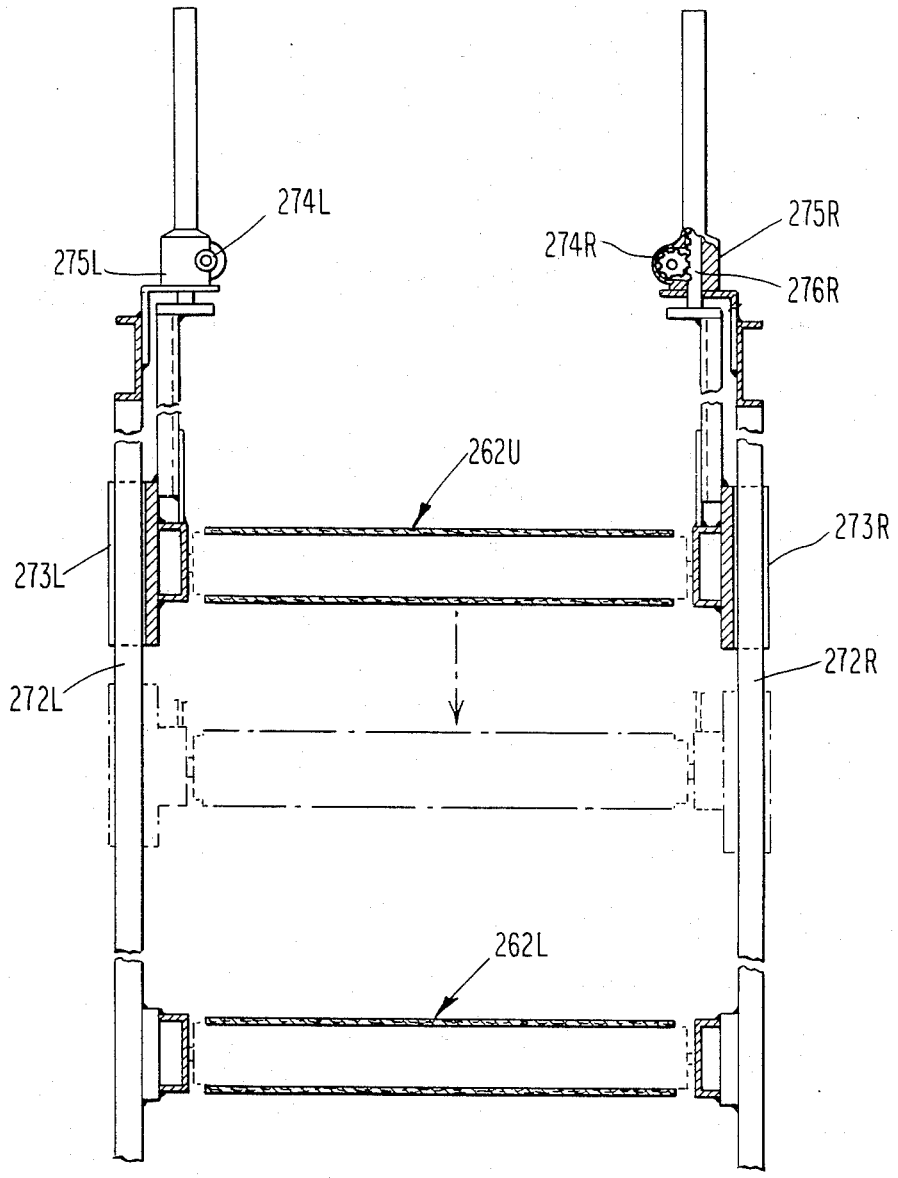
FIG. 8 Enlarged fragmentary cross-sectional view taken along VIII—VIII of FIG. 7.

All upper tractor conveyor sections 212U, 232U and 262U are vertically adjustable to accept roll units of various heights. FIG. 8 shows the mechanism whereby these upper tractor conveyor sections are adjustable. The vertical members 272L, 272R of the conveyors have guide section 273L and 273R for sliding movement thereon. Guide sections 273L and 273R have racks 276L and 276R (not shown) vertically riding on pinion gears 274L and 274R carried in supports 275L and 275R. Gears 274L and 274R are preferably driven by an AC reversible motor (not shown) in a uniform manner when lifting or dropping of conveyors is desired, although manual adjustment may instead be used if desired. The upper conveyors are thus easily set to receive roll units of various heights. Screw jacks may be used in place of the rack and pinion gears.

As shown in FIG. 7, as individual roll units 92, 93, 94, and 95 proceed to the top of incline tractor conveyors section 232, they individually pass through a photoeye 277 located near the front end of the conveyor 222U. Conveyor section 222U is constructed and operated in a manner similar to section 222L$_r$. The precise location of photoeye 277 may be upstream or downstream of the position shown, along the path of movement of the roll units, as desired. Photoeye 277 registers a count in the control circuitry for each individual unit that passes thereby. The units then proceed on holding conveyor 262 to the left end thereof as viewed in FIG. 7, where they pass by a second photoeye 278. Photoeye 278 sends another signal to the drive motor for holding conveyor 262 and the drive motor sends that roll unit over the aft edge of conveyor 262 and onto its end (as seen in phantom at the left end of FIG. 7). At that point, conveyor 262 drive motor stops for a predetermined amount of time to allow that roll unit to be transported away and to develop a preplanned spacing between individual roll units.

Figure 9:
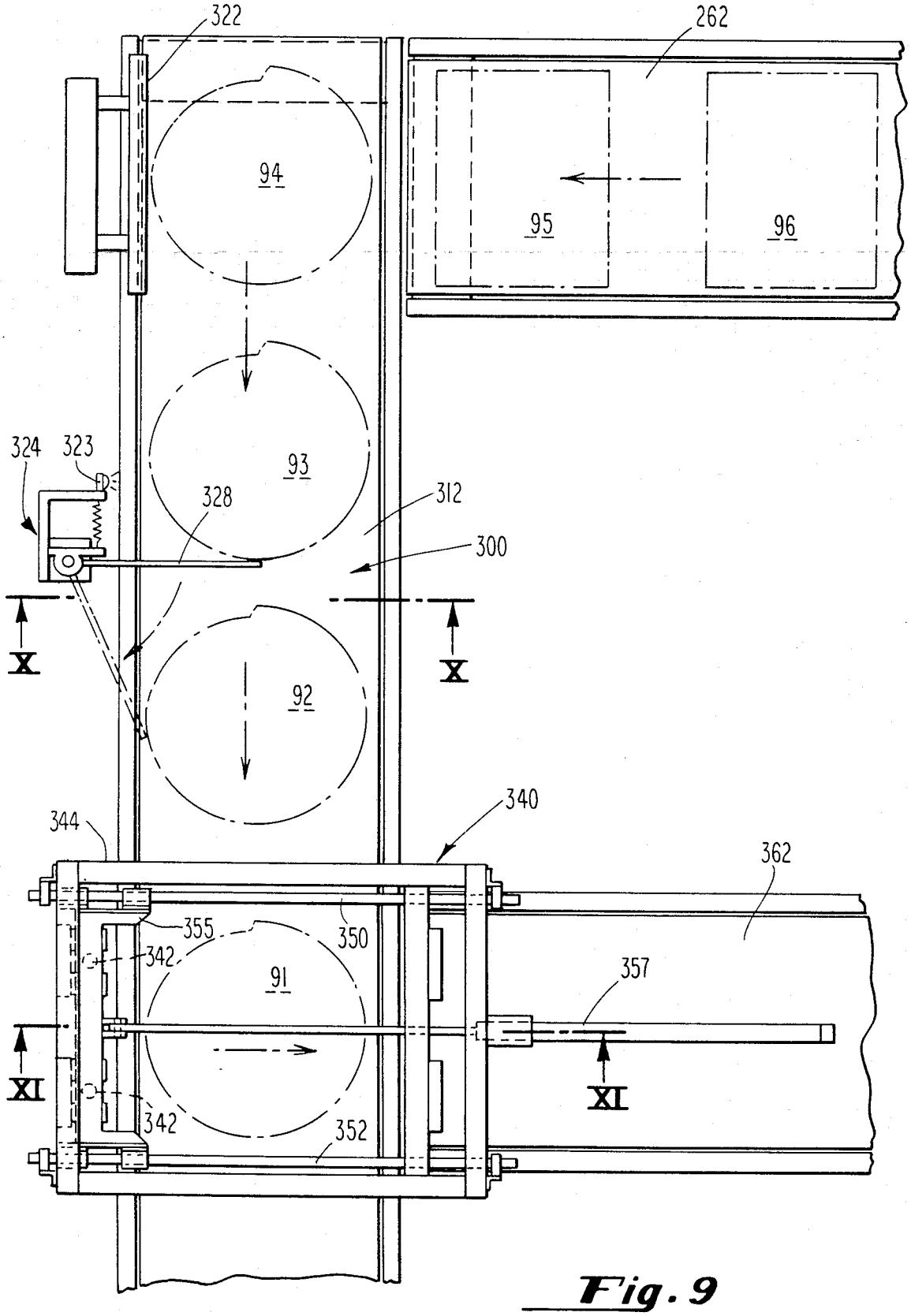
FIG. 9 Enlarged fragmentary plan view of beginning portion of Steering Section 300, with roll units shown in phantom.

As shown in FIG. 9, individual roll units are jogged off of holding conveyor 262 onto a transport conveyor 312 in steering section 300. A backstop structure 322 directly across from the end of holding conveyor 262 serves to stop roll units from tipping too far and thereby ensuring that each unit lands on an end on transport conveyor 312. The upper run of transport conveyor 312 operates in a transverse direction (out of the plane of the paper as viewed in FIG. 7) to holding conveyor 262 and at a lower elevation as shown and thereby changes the direction of movement of the individual roll units. Transport conveyor 312 operates at a constant forward speed, as driven by the similar type of aforementioned AC motor, and a starting and stopping of holding conveyor 262 after each roll unit falls off thereby causes a predetermined amount of space to be interposed between each individual roll unit.

Figure 10:
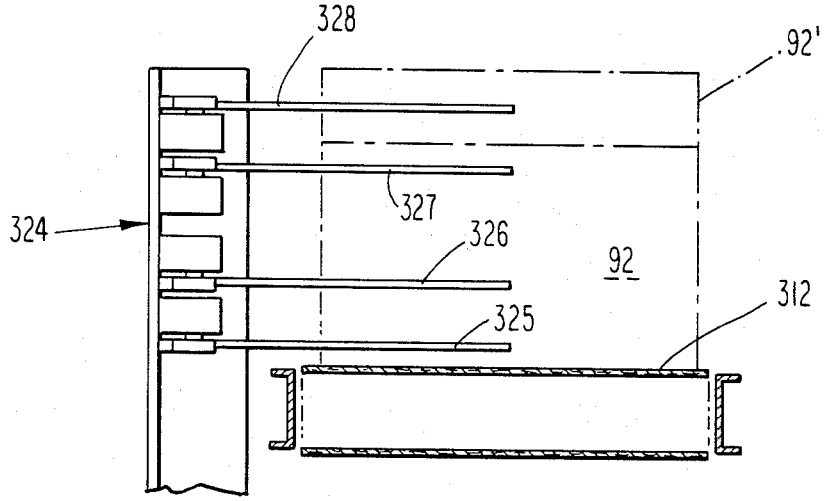
FIG. 10 Fragmentary cross-sectional view through conveyor taken along X—X of FIG. 9.

As roll unit 93 approaches a verification station 324, a plurality of photoeyes such as 323 detect the presence, height and potential defects such as telescoping of the roll units. After roll unit 93 passes photoeye 323, a signal is sent from the verification station 324 to a computer or other suitable control circuitry (not shown). Verification station 324 includes one or more electricity-conducting striker rods such as 325, (FIG. 10) extending transversely over transporting conveyor 312. Other striker rods 326, 327, and 328 activate suitable switches or computer or other control circuitry depending upon the height of the roll 92 striking the rod(s). The purpose of the verification station 324 is to verify whether a roll unit is of one of a preselected plurality of various vertical heights, e.g. 11 inches, 15 inches, or 23 inches, and the type of facing, either metal foil or Kraft, that a roll unit has. If one or more electricity-conducting leads, that are preferably connected to a DC power source (not shown) contact metal foil facing on the roll unit, a charge is registered on an appropriate meter (not shown) as the voltage is transmitted. If there is a Kraft facing on the roll unit, no charge for voltage is registered.

Figure 11:
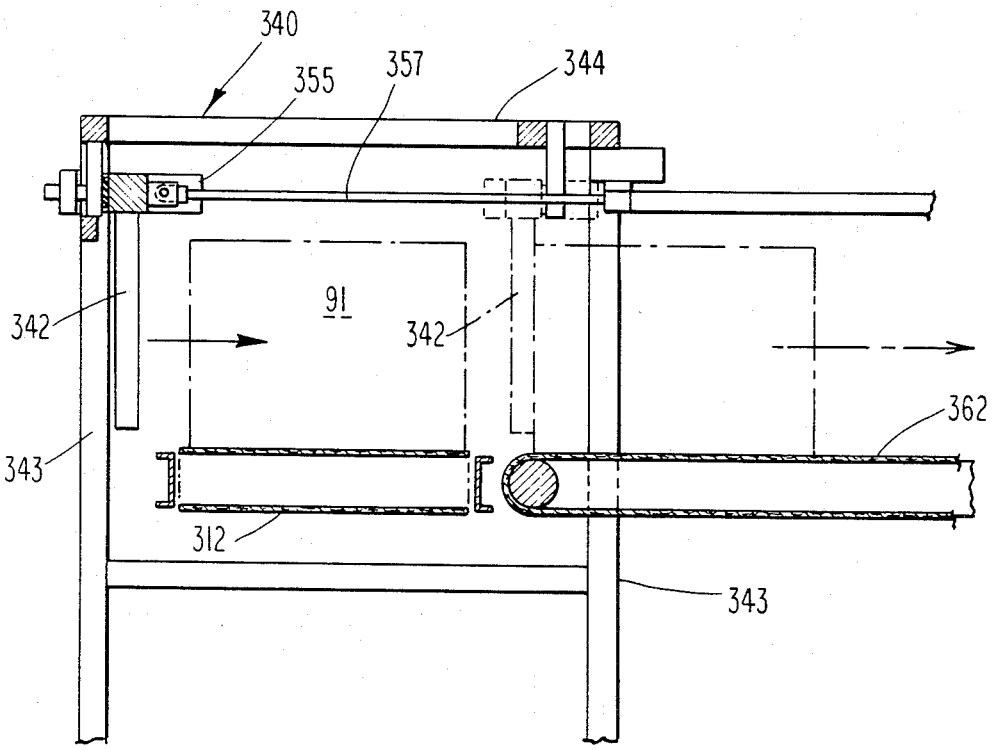
FIG. 11 Fragmentary sectional view taken along XI—XI of FIG. 9, showing right-angle transfer of rolls (in phantom) from one conveyor to another.

As seen in FIG. 11, when the proper combination of facing and height is determined at the verification station 324, a pair of guides 342 are activated and force that particular roll unit 91 onto a lateral lead-in conveyor 362. Diverter station 340 is a framework constructed as a sturdy, but lightweight bridge over transport conveyor 312. Spaced apart vertical members 343 are in parallel rectangular relationship and anchor the structure to the floor while horizontal members 344 form the top of a box-like structure. A pair of guide rails 350, 352 (FIG. 9) carry linear bearings and are set adjacent the inside of the upper surface of diverter frame 340, and vertical roll-contacting guides 342 are disposed in depending relation from the rails, carried by railslideable guide rider 355 to extend to a point just above the transport conveyor 312 as shown at the left end of FIG. 11. Guide rider 355 is connected to a pneumatic cylinder 357 and powered in a reciprocating motion as is known in the art. Cylinder 357 moves guide rider 355 in a transverse direction relative to the transport conveyor 312 and causes guides 342 to straddle an individual roll unit 91 therebetween (FIG. 9) and sweep it off of transport conveyor 312 onto lead-in conveyor 362 as shown in phantom (FIG. 11). Cylinder 357 then returns rider 355 to its former position.

FIGS. 12 and 13 show placement section 400 and roll unit 92 moving off lead-in conveyor 362 and onto a tilting conveyor 412. Lead-in conveyor 362 is at the same elevation as transport conveyor 312 and when diverter 340 pushes a roll unit transversely, it is automatically sent in the general direction of the bagging machine 450. The purpose of tilting conveyor 412 at the end of lead-in conveyor 362 is to tilt the roll unit onto its circumferential curved surface with end tab 99 in a pre-selected orientation, for the bagging operation. As a roll unit proceeds off of lead-in conveyor 362, less than one-half of its lower end, on the port side (as viewed from inside FIG. 13 looking out) is held by tilting conveyor 412 and the starboard side falls away. As shown in phantom in FIGS. 12 and 13, the roll unit rotates through 90° and lands with the end tab in proper position on surface 425. Conveyors 362 and 412 preferably have AC drive motors connected (not shown) for powering them in the normal fashion as has been previously described.

Figure 14:
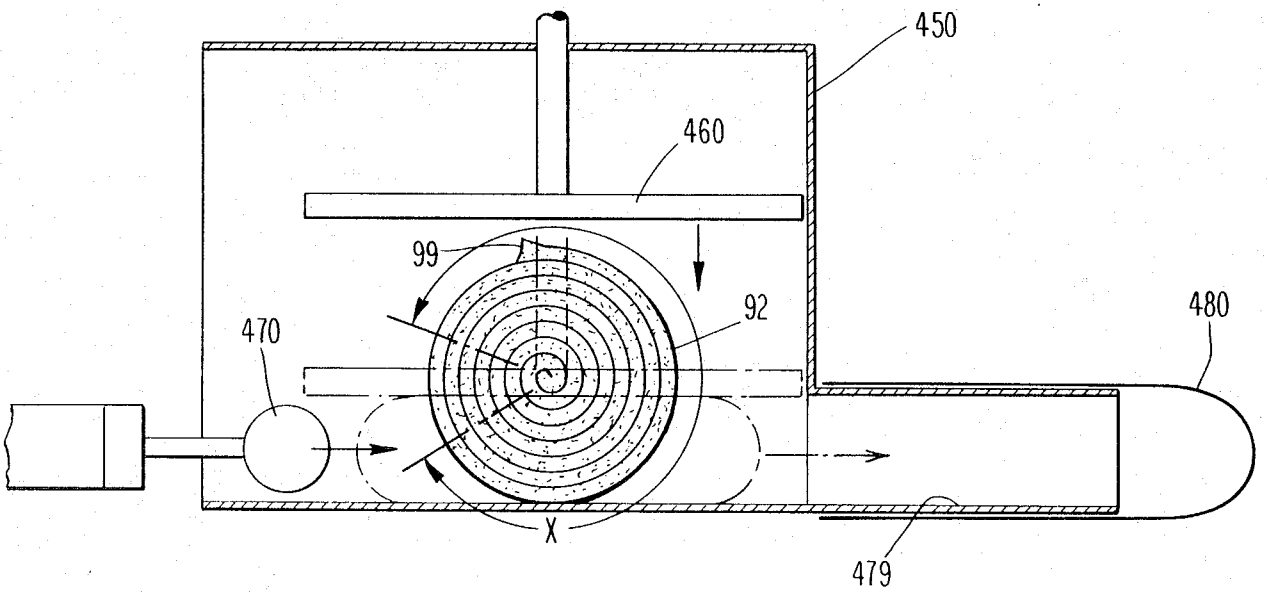
FIG. 14 Fragmentary cross-sectional view taken along XIV—XIV of FIG. 13, showing the compression of a roll unit between full line and phantom positions prior to pushing the roll into a packaging snout.

As shown in FIGS. 13 and 14, a pusher 420 adjacent a bagging machine 450 slides under guide barrier 430 and pushes the rolled unit 92 into bagging machine 450. End tab 99 is in the preferred 4 to 6 or 10 to 12 o'clock position and when the compression plate 460 forces the roll unit into a generally flattened posture (in phantom), and the ram 470 forces the roll unit into a bag 480, end tab 99 is hidden from view. While a preferred 6 or 12 o'clock position for tab 99 in the illustration of FIG. 14 has been mentioned and shown, it will be understood that end tab 99 could be located anywhere within an X between the 10 o'clock and 8 o'clock positions, and still be hidden from view.

Operation of the Automatic Insulation Packaging System

Figure 6B:
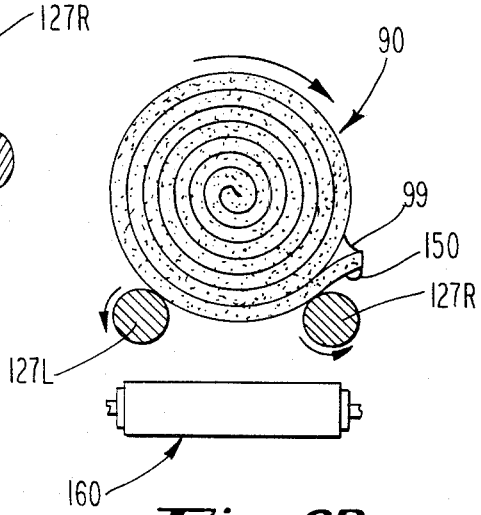
Figure 6C:
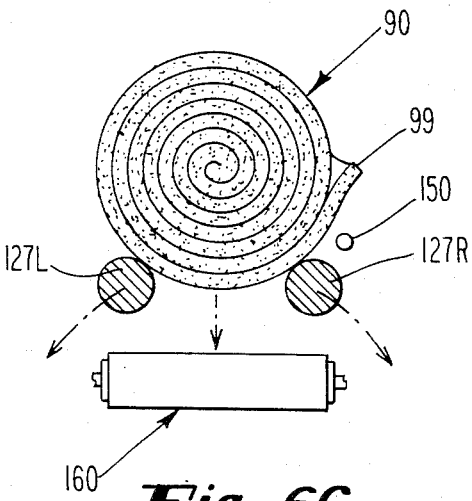
Figure 6D:
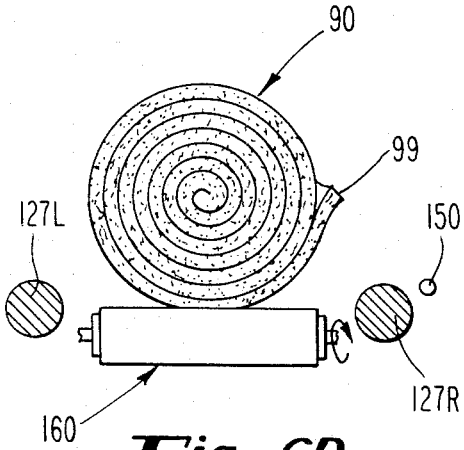

The operation of the system is as follows. A roll-set 90 is issued from the roller-up machine 50, and crosses first photoeye 109 (FIG. 3) to make the indexing section 100 aware that a roll-set is entering. Cradling mechanism 110 is in a closed position and rollers 127 at the tips of arms 111 are set so that once roll-set 90 is in position (FIG. 6A), rollers 127 start rotating the roll-set. End tab 99, from whatever position it is originally in, brushes against inner surface 128R of bumper pan 185R and interrupts second photoelectric eye 150 (FIGS. 4 and 6B) to start a timer in a logic circuit (not shown). The timer is set for a predetermined time to allow the roll-set to rotate around until end tab 99 is in a preselected orientation, e.g. at the 3 o'clock position (FIG. 6C). Then, arms 111 separate (as in phantom in FIG. 4) and roll-set 90 drops onto conveyor 160 (FIG. 6D).

If the operator should detect a defect in the roll-set, a control (not shown) causes rollers 127 to stop rotating the set, and scissor arms 111 to open up. This action drops the roll-set onto conveyor section 160. The front end of the conveyor section is elevated, (as shown in phantom in FIG. 5) and the conveyor is put into a reverse mode which then transports the roll-set out of the indexing pit (not shown, but rightward in FIG. 5). Once the roll-set is clear of conveyor 160, the motor stops and the conveyor section is lowered back to its lower position. Lifting table 131 raises up to level B' (FIGS. 2 and 4) and cradling mechanism 110 is now in a closed position ready to accept the next roll-set.

Once indexing section 100 properly sets the position of end tab 99, rollers 127 stop and cradling mechanism 110 opens up to allow the roll set to drop onto conveyor 160. Conveyor 160 operates in a forward mode and sends the roll-set into the tractor conveyor section 212 (FIG. 7).

The roll-set enters the tractor conveyor 212 and the bottom surface is picked up by lower tractor conveyor section 212$L_r$ and the upper surface is forcefully and positively conveyed by upper tractor conveyor section 212U. Since the upper section 212U is in a converging attitude to the horizontally disposed lower section 212$L_r$, the upper part of a roll-set is tightly engaged, and even slightly deformed in its forward movement. Concurrently, the lower part of the roll-set is engaged by faster-moving inclined roll-break conveyor 212$L_r$ and the movement of this conveyor opens from below a gap in between the faces of adjoining roll units to effect a clean separation between units. The further movement of rolls between upper and lower incline roll break conveyor 212$L_r$ causes a space to develop between roll units and this space is maintained as each individual roll unit proceeds up the incline.

As the individual roll units arrive at the top of the incline section, they pass through photoelectric eye 277. Eye 277 starts a count which is then passed on to second photoelectric eye 278 at the end of the holding conveyor 262. Holding conveyor 262 transports each roll unit to the aft end of roll break section 200. As a roll unit breaks the beam of second photoelectric eye 278 and is jogged forward onto its forward end onto transport conveyor 312, holding conveyor 262 is preferably timed to stop to allow that roll unit to move away from the jogging area to allow sufficient spacing between roll units.

The individual roll units are now brought in front of the verification section 324, and this section detects whether a unit is present, the height of a particular unit, and the facing on that unit. Once these characteristics have been determined, the unit is transported to the proper diverter 340 which is preprogrammed to move the unit through a 90° angle towards the bagging machine that has a predetermined packaging material. When the roll unit arrives in front of diverter 340, the vertical guides 342 engage the unit and sweep the unit off transport conveyor 312. End tab 99 on each individual roll unit is in a proper position when the roll unit arrives at tilting conveyor 412.

As the roll unit arrives at tilting conveyor 412, it is tilted through a second 90° angle, and lands on a curved side. End tab 99 is in a preferred orientation, e.g. the 6 or 12 o'clock position, and in this posture, the roll unit is shoved into the bagging machine, compressed into a generally flat unit, and rammed into the proper bag or other packaging material.

Obviously, many modifications and variations of the abovedescribed fiberglass roll-unit processing system are possible in light of the above teachings, and it is therefore understood that within the scope of the disclosed inventive concepts, the invention may be practiced otherwise than specifically disclosed. In particular, while the drawings show four bagging machine stations (FIG. 1), it is understood that the specific number may vary from one to six, or more, depending upon such production factors as size of plant facility and demand of individual types of roll units.

It is also understood that the operation could be controlled by a computer, and that all input signals from the sensors located in the system would be integrated into the operation. In this mode of operation, all hereindescribed control circuits would be connected to and through the computer, and the entire time for the process could be controlled from start to finish.

What is claimed is:

1. An automated system for processing insulation roll units of different facings and widths for packaging comprising:

a. receiving means located adjacent a production line for receiving a roll-set from the production line, and orienting said set for a desired placement of end tabs thereof;

b. roll-set breaking means located adjacent said receiving means for receiving a set of a plurality of separable but connected-together roll units and for separating said set into a plurality of individual roll units;

c. verifying means located downstream of said roll-set breaking means for verifying preselected characteristics of said units;

d. delivery means located downstream of said roll-set breaking means for conveying roll units to a packaging station while maintaining desired predetermined orientations of the units to deliver them for packaging, each under a predetermined packaging orientation; and e. at least one packaging means located downstream of said verifying means and delivery means for packaging rolls with end tabs thereof in predetermined orientation, wherein said receiving means includes cradling means located at a first upper position for releasably grasping said set therebetween and connected to a first drive means for rotating said set to a preselected final position while maintaining said set above a predetermined level, wherein said cradling means comprise at least two pair of spaced apart scissor-acting arms for releasably and adjustably holding said set, each said pair having pivoting arms on a common longitudinally disposed axis, said arms being movably connected to a first lifting means for causing an opening and a closing thereof and having longitudinally parallel rollers disposed at the tips thereof and connected to said first drive means to simultaneously grasp and rotate said set about its longitudinal axis.

2. A processing system as in claim 1 wherein said lifting means is a table located beneath said cradling means and ridingly connected at each end thereof to a guide set means fixedly attached to one said base and movable by at least one pneumatic cylinder.

3. A processing system as in claim 1 wherein said cradling means include a pair of bumper pans fixedly mounted to opposite arms to cushion said set as it rests in said cradling means.

4. An automated system for processing insulation roll units of different facings and widths for packaging comprising:

a. receiving means located adjacent a production line for receiving a roll-set from the production line, and orienting said set for a desired placement of end tabs thereof;

b. roll-set breaking means located adjacent said receiving means for receiving a set of a plurality of separable but connected-together roll units and for separating said set into a plurality of individual roll units;

c. verifying means located downstream of said roll-set breaking means for verifying preselected characteristics of said units;

d. delivery means located downstream of said roll-set breaking means for conveying roll units to a packaging station while maintaining desired predetermined orientations of the units to deliver them for packaging, each under a predetermined packaging orientation; and e. at least one packaging means located downstream of said verifying means and delivery means for packaging rolls with end tabs thereof in predetermined orientation, wherein said receiving means includes cradling means located at a first upper position for releasably grasping said set therebetween and connected to a first drive means for rotating said set to a preselected final position while maintaining said set above a predetermined level, wherein said receiving means includes conveyor means connected to a second drive means and located at a first lower position for engaging said set and releasably transporting said set away from said receiving means, wherein said conveyor means includes rejection means for ejecting a defective roll set backwards out of said receiving means.

5. An automated system for processing insulation roll units of different facings and widths for packaging comprising:

a. receiving means located adjacent a production line for receiving a roll-set from the production line, and orienting said set for a desired placement of end tabs thereof;

b. roll-set breaking means located adjacent said receiving means for receiving a set of a plurality of separable but connected-together roll units and for separating said set into a plurality of individual roll units;

c. verifying means located downstream of said roll-set breaking means for verifying preselected characteristics of said units;

d. delivery means located downstream of said roll-set breaking means for conveying roll units to a packaging station while maintaining desired predetermined orientations of the units to deliver them for packaging, each under a predetermined packaging orientation; and e. at least one packaging means located downstream of said verifying means and delivery means for packaging rolls with end tabs thereof in predetermined orientation, wherein said receiving means includes cradling means located at a first upper position for releasably grasping said set therebetween and connected to a first drive means for rotating said set to a preselected final position while maintaining said set above a predetermined level, wherein said receiving means includes conveyor means connected to a second drive means and located at a first lower position for engaging said set and releasably transporting said set away from said receiving means, wherein said conveyor means includes rejection means for ejecting a defective roll set backwards out of said receiving means, wherein said rejection means comprises lifting means connected to said conveyor means at an end thereof, for raising and lowering the end of said conveyor means from a horizontal position to a raised position.

6. An automated system for processing insulation roll units of different facings and widths for packaging comprising:

a. receiving means located adjacent a production line for receiving a roll-set from the production line, and orienting said set for a desired placement of end tabs thereof;

b. roll-set breaking means located adjacent said receiving means for receiving a set of a plurality of separable but connected-together roll units and for separating said set into a pluralitY of individual roll units;

c. verifying means located downstream of said roll-set breaking means for verifying preselected characteristics of said units;

d. delivery means located downstream of said roll-set breaking means for conveying roll units to a packaging station while maintaininq desired predetermined orientations of the units to deliver them for packaging, each under a predetermined packaging orientation; and e. at least one packaging means located downstream of said verifying means and delivery means for packaging rolls with end tabs thereof in predetermined orientation, wherein said delivery means includes:

a. first delivery conveyor disposed to receivably accept a roll unit at one end thereof and transport the unit to a tilting conveyor means; and b. tilting conveyor means transversely narrower than said first delivery conveyor so as to accept less than one-half of the end surface of a roll unit and thereby cause said unit to rotate through ninety degrees onto its side.

7. In a production insulation roll processing system for accepting pre-slit insulation roll-sets from upstream slitting and rolling operations, the improvement comprising receiving means for accepting a roll-set including:

a. orienting means located adjacent the roller-up machine, for rotating the roll-set a predetermined amount; and b. conveyor means located below said predetermined level for receivingly accepting the roll-set from said orienting means and transporting the roll-set in a forward direction out of said receiving means, wherein said orienting means comprise cradling means located at a first upper position for releasably grasping said set therebetween along the longitudinal axis thereof and connected to a first drive means for rotating said set to a preselected final position while maintaining said set above a predetermined level, wherein said cradling means comprise at least two pair of spaced apart scissor-acting arms for releasably and adjustably holding said set, each said pair having pivoting arms on a common longitudinally disposed axis, said arms being movably connected to a first lifting means for causing an opening and a closing thereof and having longitudinally parallel rollers disposed at the tip thereof and connected to said first drive means to simultaneously grasp and rotate a roll-set about its longitudinal axis.

8. In a production insulation roll processing system for accepting pre-slit insulation roll-sets from upstream slitting and rolling operations, the improvement comprising receiving means for accepting a roll-set including:

a. orienting means located adjacent the roller-up machine, for rotating the roll-set a predetermined amount; and b. conveyor means located below said predetermined level for receivingly accepting the roll-set from said orienting means and transporting the roll-set in a forward direction out of said receiving means, wherein said conveyor means is reversibly drivable, and is pivotable about one end thereof to eject a roll-set and has moving means connected thereto to move an opposite end thereof for raising and lowering of one of the ends of said conveyor means.

* * * * *